US005644939A

United States Patent [19]

Willems

[11] Patent Number: 5,644,939

[45] Date of Patent: Jul. 8, 1997

[54] STRAIGHTENING MACHINE FOR ROLLED BEAMS

[75] Inventor: Markus Willems, Erkrath, Germany

[73] Assignee: SMS Schloemann-Siemag Aktiengesellschaft, Dusseldorf, Germany

[21] Appl. No.: 375,906

[22] Filed: Jan. 20, 1995

[51] Int. Cl.[6] ..... B21D 3/04

[52] U.S. Cl. ..... 72/164; 72/247

[58] Field of Search ..... 72/160, 162, 164, 72/224, 225, 247

[56] References Cited

U.S. PATENT DOCUMENTS 4,022,046 5/1977 Serizawa et al. ..... 72/164

5,060,498 10/1991 Seto et al. ..... 72/164

5,191,780 3/1993 Ohmori et al. ..... 72/164

*Primary Examiner*—Lowell A. Larson

*Assistant Examiner*—Thomas C. Schoeffler

*Attorney, Agent, or Firm*—Friederich Kueffner

[57] ABSTRACT

A straightening machine for rolled beams, particularly hyper-beams, includes two straightening disks which are mounted on a straightening shaft and rest against the flanges of the beams from the inside, wherein at least one of the two straightening disks is axially displaceable. A support ring is arranged between the straightening disks. The support ring has distributed over the circumference thereof a plurality of hydraulic cylinders. The adjusting pistons of the hydraulic cylinders are connected to the axially displaceable straightening disk.

10 Claims, 2 Drawing Sheets

21
20
41
19
19
39
22
37
38
31,32,33
6
16
15
17
8
7
5
11
3
26
27
40
41
25
4
18
21
20
24
23
3a
10
12
9
2a
11
2
14
13
1

STRAIGHTENING MACHINE FOR ROLLED BEAMS

BACKGROUND OF THE INVENTION

1. Field of the Invention

The present invention relates to a straightening machine for rolled beams, particularly hyper-beams. The straightening machine includes two straightening disks which are mounted on a straightening shaft and rest against the flanges of the beams from the inside, wherein at least one of the two straightening disks is axially displaceable.

2. Description of the Related Art

A straightening shaft for straightening means of the above-described type has become known from DE-35 22 976 A1. This known straightening machine is used to straighten rails. However, particularly in the case of hot rolled I-beams or hyper-beams to be straightened, it must be taken into consideration that these beams have a constant height dimension in dependence on a series being manufactured, while the flange thicknesses may vary. The use of constant structural heights makes it possible in building construction to use optimized corner connections or gussets of the beams with different section moduli. To make it possible to roll hyper-beams with different flange thicknesses, it is known in the art to adjust the rolling disks of the rolls in the rolling stands of rolling mill trains in such a way that, on the one hand, the constant height dimension of the beams is maintained, while, on the other hand, different flange thicknesses can be rolled. The time required for the adjustment of the roll stand is approximately 30 seconds.

At the present time, straightening in a straightening machine arranged following a rolling mill train is carried out in such a way that the beams are moved into the straightening machine resting on their flanges and the beams then travel with the webs over the straightening disks. This means that the flanges must be plastically deformed during straightening and all required straightening forces are conducted into the flanges through the webs and the transition radii from the webs to the flanges. Since the deformation of the webs also causes breathing of the flanges and an axial force acting on the straightening disks so as to clamp the beam, a construction is required which is stable in axial direction. Therefore, the straightening disks are fixedly mounted on a mounting sleeve and are completely replaced as required. The straightening disks are mounted by means of spacer sleeves or spacer disks which correspond to the internal flange spacing, wherein the internal flange spacing is defined as the distance between the inner surfaces of the flanges which face each other. The mounting sleeve unit is placed directly on the straightening shaft and is axially tensioned by means of a tensioning nut or a chuck. If the internal flange spacing varies as a result of different flange thicknesses, this means that the change-over time is very long because each deviation from the internal flange spacing inevitably results in a change of the mounting sleeve unit.

SUMMARY OF THE INVENTION

Therefore, it is the primary objection of the present invention to provide a straightening machine of the above-described type in which it is possible to rapidly change the distance between the straightening disks. The straightening machine should also be simple and easy to maintain.

In accordance with the present invention, a support ring is arranged between the straightening disks. The support ring has distributed over the circumference thereof a plurality of hydraulic cylinders. The adjusting pistons of the hydraulic cylinders are connected to a straightening disk.

Since at least one of the straightening disks of the straightening shaft is connected to the adjusting pistons, preferably through threaded bolts by means of a screw connection, this straightening disk can be adjusted by applying the displacement pressure (approximately 100 bar) on the adjusting pistons and, thus, the internal flange spacing can be adapted to changed flange thicknesses. Of course, it is possible in the same manner to adjust the straightening disks to a series having essentially different beam dimensions. The second straightening disk can remain stationary once it is fixed in its position. On the other hand, it would also be possible to axially adjust both straightening disks; in that case, hydraulic cylinders could be arranged in the support ring extending from both end faces thereof.

In accordance with an advantageous feature, the hydraulic cylinders are threaded elements which are screwed into bores provided in the support ring. Thus, the hydraulic cylinders are structural units which can be completely screwed in and replaced.

In accordance with a preferred development of the invention, circular lines for connecting the hydraulic cylinders to each other are provided. This permits a synchronous movement of the adjusting pistons when the displacement pressure is applied.

In accordance with another proposal, pressure medium connections leading to the hydraulic cylinders are provided for carrying out an adjusting stroke, a return stroke and for clamping the adjusting pistons. In this case, the support ring has three circular lines, wherein each circular line is provided with a central medium coupling unit in the form of a quickly connectable plug-in coupling. Alternatively, instead of using a hydraulically operated return stroke, the adjusting pistons can also be provided with a spring-operated return unit.

In accordance with another development, the pressure medium connection leads to a pressure space formed between each hydraulic cylinder and a sleeve surrounding the adjusting pistons. Accordingly, a hydraulic pressure of approximately 500 bar is applied from the outside against the sleeve so as to secure the adjusting piston in its position, so that the high straightening forces do not cause an undesired change in position.

In accordance with an advantageous feature, the support ring is mounted on a key and is braced from one side against a counterring which is screwed onto a threaded portion of a mounting sleeve surrounding the straightening journal of the straightening shaft. As a result, the support ring can be quickly and easily mounted and secured. On the other hand, an automatic positioning is obtained in such a way that the hydraulic cylinders of the support ring and the threaded bolts of the straightening disk which is also guided on a key are located opposite each other in a defined or aligned manner.

In order to make it possible to monitor the position of the straightening disks, an axial blind bore of the support ring may be provided with a position sensor and a magnet corresponding to the position sensor may be arranged in the straightening disk. The blind bore may be arranged on the same reference circle as the bores for the hydraulic cylinders arranged distributed over the circumference in the end face of the support ring. This simplifies the manufacture because all bores can be bored and manufactured in one work step.

The various features of novelty which characterize the invention are pointed out with particularity in the claims annexed to and forming a part of the disklosure. For a better understanding of the invention, its operating advantages, specific objects attained by its use, reference should be had to the drawing and descriptive matter in which there are illustrated and described preferred embodiments of the invention.

DETAILED DESCRIPTION OF THE PREFERRED EMBODIMENTS

Figures 1, 3:
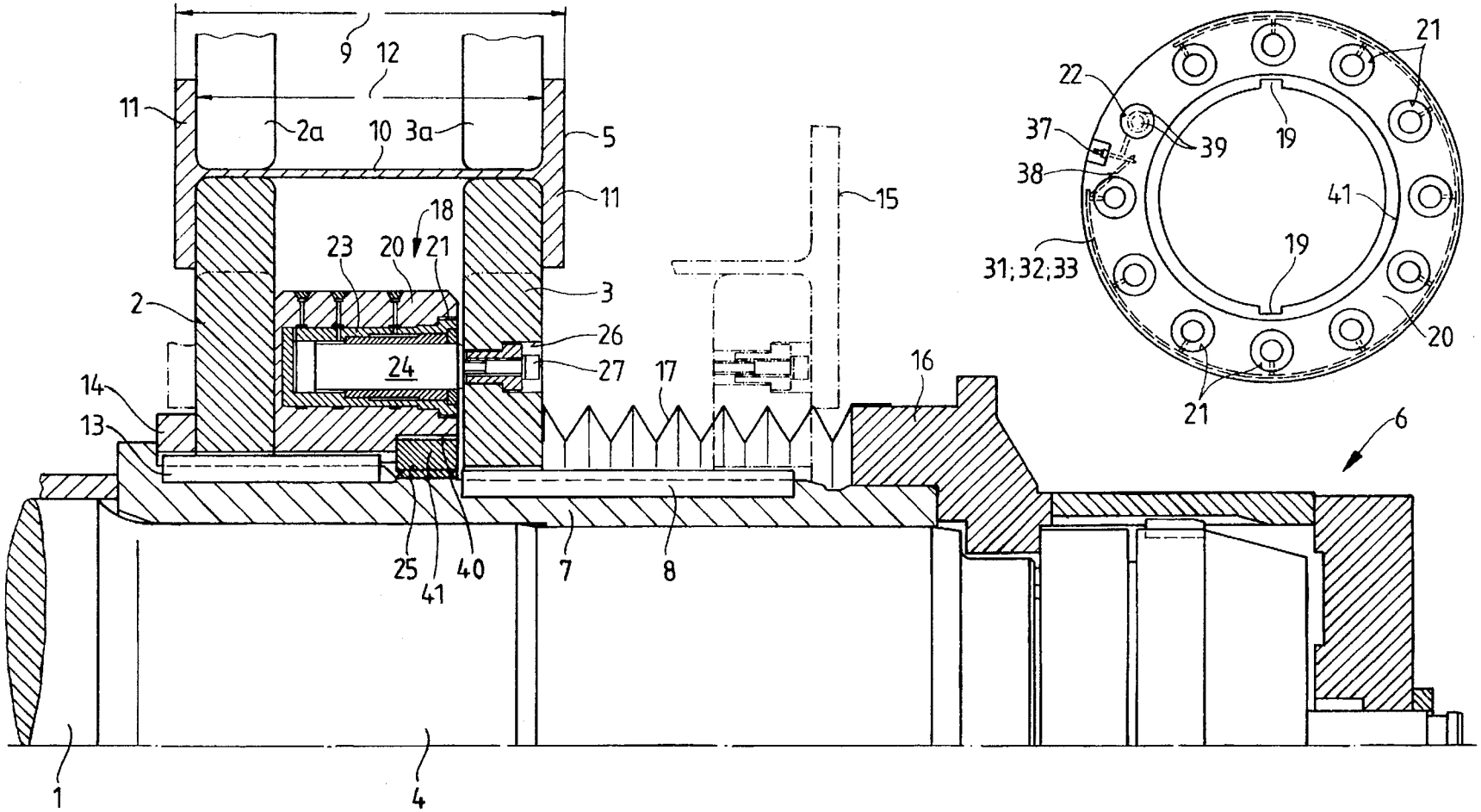
FIG. 1 is a partially sectional view of a detail of a roller straightening machine showing the straightening disks mounted on a straightening journal of a straightening shaft with an adjusting unit according to the present invention.
FIG. 3 is a front view of the nut receiving the hydraulic cylinders of the hydraulic adjusting unit.

FIG. 1 of the drawing shows as part of a straightening machine a straightening journal 4 of a lower straightening shaft 1. Straightening disks 2, 3 are mounted on the lower straightening shaft 1. FIG. 1 only schematically shows the straightening disks 2*a*, 3*a* of an upper straightening shaft, not shown. The lower straightening disks 2, 3 and the upper straightening disks 2*a*, 3*a* interact with each other for straightening a hot rolled hyper-beam 5.

At the free end of the rotatable straightening journal 4 is provided a known chuck 6 which is used for clamping a mounting sleeve 7 receiving the straightening disks 2, 3 against the straightening journal 4.

The mounting sleeve 7 is provided with a guide key 8 on which the straightening disk 3 on the right hand side in FIG. 1 can be adjusted outwardly. This is done when the roll stands of a rolling mill train arranged in front of the straightening machine are converted for rolling beams having a smaller thickness of the flange 11 while the structural height 9 of the beam 5 reminds the same, so that the internal flange spacing 12 is changed accordingly. This is because the straightening disks 2, 3, which rest against the flanges 11 from the inside and against the web 10 from the top and the bottom, must be moved further apart or closer together. In the illustrated embodiment, the straightening disk on the left hand side of FIG. 1 is mounted stationary on a key 13 of the mounting sleeve 7. The straightening disk 2 rest against a stop member 14.

As can further be seen in FIG. 1, it is additionally possible to adjust the outer straightening disk 3 on the right hand side when the dimension of the structural height 9 changes as a result of a change in the series of beams being manufactured. This is illustrated in dash-dot lines partially showing a beam 15 which is rolled to almost twice the structural height as the hyper-beam 5. In that case, it is necessary to mount on the mounting sleeve 7 straightening disks and spacer disks adjusted to the series of beams being manufactured.

A bellows 17 arranged between a sleeve member 16 of the chuck 6 and the right straightening disk 3 protects the free end of the guide key 8 of the straightening disk 3.

For displacing the straightening disk 3, a displacement unit 18 is provided between the straightening disks 2, 3 or 2*a*, 3*a*, respectively. The displacement unit 18 includes a support ring 20 which is provided with grooves 19, as illustrated in FIG. 3. In the illustrated embodiment, the support ring 20 has a total of twelve blind bores 21 or 22, respectively, which are arranged distributed over the circumference of the annular surface thereof, wherein, with the exception of the blind bore 22, all other bores 21 receive a hydraulic cylinder 23 with an adjusting piston 24 arranged in each hydraulic cylinder 23, as can be seen in FIGS. 1 and 2.

The support ring 20 is mounted on the key 13 of the mounting sleeve 17 which also guides the left straightening disk 2. On its annular surface facing the movable straightening disk 3 on the right hand side, the support ring 20 is provided with a recess 40 which is concentric to the shaft 4. A counterring 41 provided with an internal thread can be screwed into the recess 40 on an external thread portion 25 of the mounting sleeve 7. Threaded bolts 27 are arranged in axial bores 26 of the axially displaceable straightening disk 3 on the right hand side. The threaded bolts 27 are screwed into the adjusting pistons 24.

Figure 2:
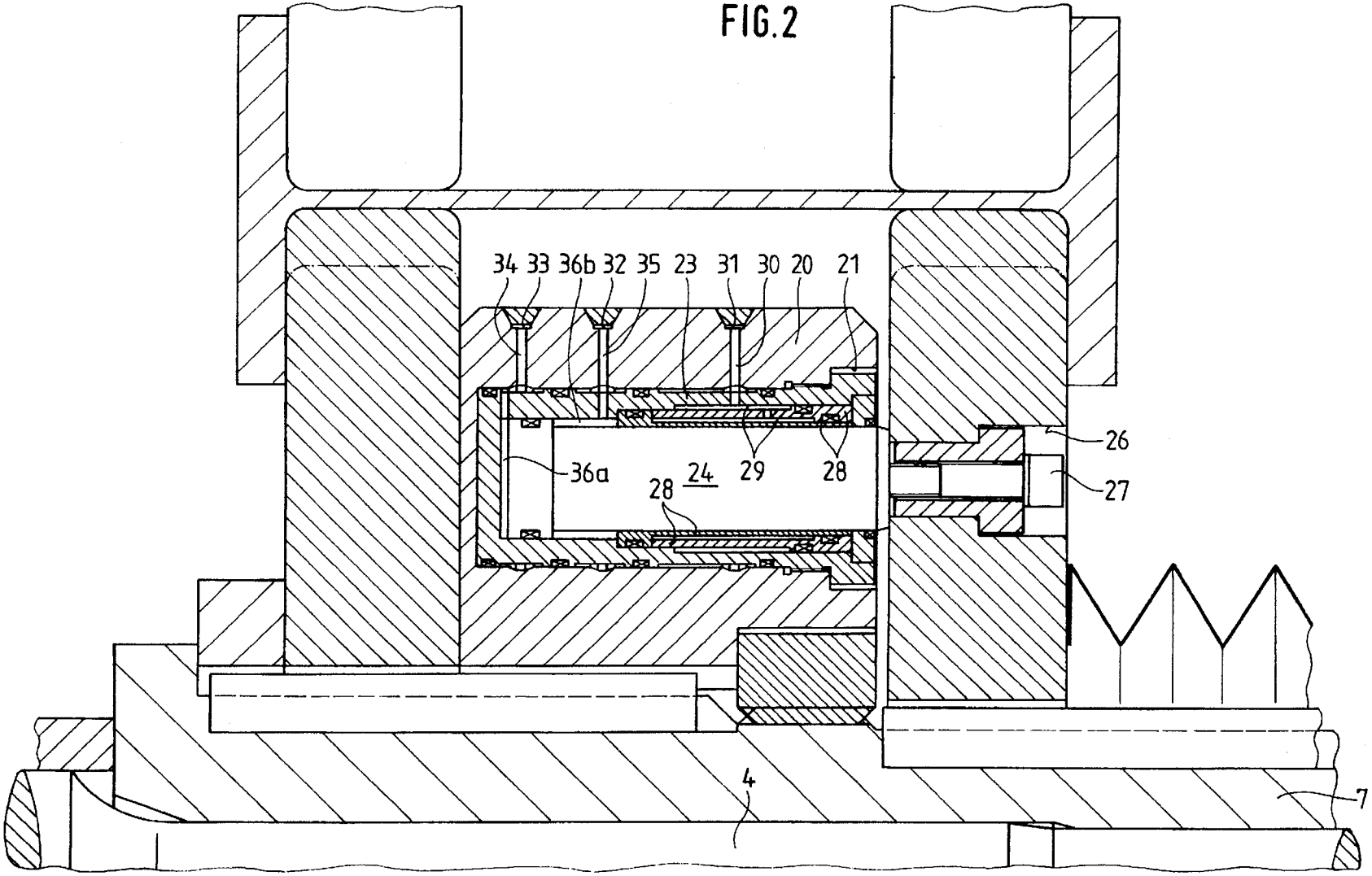
FIG. 2 is a partially sectional view, on a larger scale, of the straightening disks with the adjusting unit of FIG. 1.

As can be seen from the enlarged illustration of FIG. 2, the adjusting pistons 24 are surrounded over a partial length thereof by a sleeve 28 and a pressure space 29 is provided between the hydraulic cylinder 23 and the sleeve 28, wherein the pressure space 29 is connected through a transverse bore 30 to an annular line 31. The support ring 20 has two additional annular lines 32, 33 which are in connection with pressure medium connections in the form of transverse bores 34, 35 leading to the hydraulic cylinders 23 for carrying out an adjusting stroke and a return stroke.

As illustrated in FIGS. 1 and 2, the annular line 33 on the left supplies pressure medium through the transverse bores 34 to pressure spaces 36*a* on the end face of the pistons and the annular line 32 supplies pressure medium through the transverse bores 35 to the pressure spaces 36*b* of the hydraulic cylinders 23 at the cylindrical surfaces of the pistons. Consequently, when pressure medium is supplied to the pressure spaces 36*a*, a displacement to the right is carried out and the straightening disk 3 is moved on the key 8 away from the straightening disk 2. The return stroke, i.e., the movement of the straightening disks 2, 3 toward each other, is effected by introducing pressure liquid into the pressure spaces 36*b* which causes the adjusting pistons 24 and, thus, the straightening disk 3 to be moved toward the left. For securing the straightening disk 3 in its adjusted position, the sleeves 28 are pressed against the adjusting pistons 24 by introducing hydraulic liquid into the pressure spaces 29 through the annular line 31 and the transverse bores 30. Of course, all pressure spaces are sealed.

A simple connection of the annular lines 31–33 which centrally supply all hydraulic cylinders 23 to a pressure medium source is effected by a connection 37 for a plug-in coupling provided in the support ring 20. A plug-in coupling connection 37 is provided for each annular line 31, 32, 33. Each connection 37 is connected through a distribution bore 38 to the respective annular line.

For controlling the position of the adjusted or axially displaced straightening disk 3, a position sensor 39 is mounted in the blind bore 22 of the support ring 20 as schematically illustrated in FIG. 3. A magnet, not shown, is arranged in the straightening disk 3 corresponding to the positioning sensor 39.

Accordingly, in order to achieve an adjustment of the straightening machine arranged following a rolling train simultaneously with the quick adjustment of the rolling disks of the roll stands of the rolling train without losing time, it is only necessary for the desired adjustment of the straightening disk to connect the annular lines 32 or 33 to be supplied with hydraulic liquid to the pressure medium supply, so that the adjusting pistons 24 can carry out an adjusting stroke or return stroke and, thus, the straightening disk 3 is axially displaced into the desired position controlled by the position sensor 39. Subsequently, pressure medium is introduced into the annular line 31, so that a clamping pressure is applied on the adjusting pistons 24 through the sleeves 28 in order to secure the straightening disk 3 in its position. The clamping pressure is maintained during the straightening process.

The invention is not limited by the embodiments described above which are presented as examples only but can be modified in various ways within the scope of protection defined by the appended patent claims.

I claim:

1. A straightening machine for rolled beams, the beams having flanges, the flanges having insides facing each other, the straightening machine comprising a rotatable straightening shaft, two straightening disks mounted on the straightening shaft, wherein at least one of the two straightening disks is axially displaceable, further comprising a support ring mounted between the straightening disks, the support ring having a circumference, the support ring comprising a plurality of hydraulic cylinders arranged distributed over the circumference of the support ring, each hydraulic cylinder having an adjusting piston, wherein the adjusting pistons are connected to the axially displacable straightening disk.

2. The straightening machine according to claim 1, comprising threaded connections between the hydraulic cylinders and the support ring.

3. The straightening machine according to claim 1, comprising annular lines for connecting the hydraulic cylinders to one another.

4. The straightening machine according to claim 1, comprising pressure medium connections in communication with the hydraulic cylinders for carrying out an adjustment stroke and a return stroke of the adjusting pistons and for clamping the adjusting pistons.

5. The straightening machine according to claim 1, comprising a spring means for carrying out a return movement of the axially adjustable straightening disk.

6. The straightening machine according to claim 4, wherein the pressure medium connection for carrying out clamping of the adjusting pistons is in communication with a pressure space defined between each hydraulic cylinder and a sleeve surrounding the hydraulic cylinder.

7. The straightening machine according to claim 1, wherein the axially displacable straightening disk comprises threaded bolts, the threaded bolts being screwed into the adjusting pistons.

8. The straightening machine according to claim 1, wherein the straightening shaft has a straightening journal surrounded by a mounting sleeve, the mounting sleeve having a key and a threaded portion, the support ring being arranged on the key and being clamped by a counterring screwed from one side onto the threaded portion.

9. The straightening machine according to claim 1, wherein the axially displacable straightening disk is mounted on another key of the mounting sleeve.

10. The straightening machine according to claim 1, wherein the support ring has an axial blind bore, a position sensor being mounted in the axial blind bore.

* * * * *